US005082765A

United States Patent [19]

Onodera et al.

[11] Patent Number: 5,082,765

[45] Date of Patent: * Jan. 21, 1992

[54] METHOD OF PROCESSING LIGHT-SENSITIVE SILVER HALIDE PHOTOGRAPHIC MATERIAL

[75] Inventors: Kaoru Onodera, Odawara; Keiji Ohbayashi, Hino; Mitsuhiro Okumura, Hino; Shigeo Chino, Hino, all of Japan

[73] Assignee: Konica Corporation, Tokyo, Japan

[ * ] Notice: The portion of the term of this patent subsequent to Oct. 16, 2007 has been disclaimed.

[21] Appl. No.: 598,798

[22] Filed: Oct. 15, 1990

Related U.S. Application Data

[63] Continuation of Ser. No. 402,982, Sep. 1, 1989, abandoned, which is a continuation of Ser. No. 303,967, Jan. 27, 1989, abandoned, which is a continuation of Ser. No. 33,506, Apr. 1, 1987, abandoned.

[30] Foreign Application Priority Data

Apr. 4, 1986 [JP] Japan ..... 61-78891

[51] Int. Cl.[5] ..... G03C 7/46; G03C 1/16

[52] U.S. Cl. ..... 430/377; 430/487; 430/490; 430/576; 430/583; 430/380

[58] Field of Search ..... 430/376, 490, 487, 576, 430/583, 377, 380

[56] References Cited

U.S. PATENT DOCUMENTS

| | | | |
|---|---|---|---|
| 3,652,277 | 3/1972 | Hara et al. | 430/576 |
| 4,237,214 | 12/1980 | Mifune et al. | 430/441 |
| 4,546,074 | 10/1985 | Kamei et al. | 430/573 |
| 4,555,482 | 11/1985 | Inoue et al. | 430/574 |
| 4,556,633 | 12/1985 | Tanemura et al. | 430/573 |
| 4,607,006 | 8/1986 | Hirano et al. | 430/576 |
| 4,713,321 | 12/1987 | Mifune et al. | 430/581 |
| 4,774,167 | 9/1988 | Koshimizu et al. | 430/380 |

FOREIGN PATENT DOCUMENTS 660408 11/1951 United Kingdom .

*Primary Examiner*—Richard L. Schilling
*Assistant Examiner*—Janet C. Baxter
*Attorney, Agent, or Firm*—Jordan B. Bierman

[57] ABSTRACT

A method of processing a light-sensitive silver halide color photographic material wherein a light-sensitive silver halide photographic material having a support and provided thereon at least one silver halide emulsion layer containing a dye-forming coupler and silver halide grains which are sensitized with specific sensitizing dyes, is processed with a color developer solution containing specific aromatic primary amine color developing agents.

9 Claims, No Drawings

METHOD OF PROCESSING LIGHT-SENSITIVE SILVER HALIDE PHOTOGRAPHIC MATERIAL

This application is a continuation, of application Ser. No. 07/402,982, filed Sep. 1, 1989, now abandoned, which is a continuation, of application Ser. No. 303,967, filed Jan. 27, 1989, abandoned, which is a continuation, application Ser. No. 033,506, filed Apr. 1, 1987 abandoned.

FIELD OF THE INVENTION

This invention relates to a method of processing light-sensitive silver halide photographic material (hereinafter referred to as a light-sensitive material) and, more particularly, to a method of processing a color light-sensitive material capable of preventing dye-stains which may be produced by spectral sensitizers even under the conditions of a rapid development process.

BACKGROUND OF THE INVENTION

A light-sensitive silver halide color photographic material is generally comprised of a support, and coated thereon three different kinds of silver halide photographic emulsion layers spectrally sensitized selectively so as to be sensitive to blue, green and red rays of light, respectively. For example, a light-sensitive silver halide color photographic material for color negative photographic use is generally coated with a blue-sensitive, green-sensitive and red-sensitive silver halide emulsion layers in order from the side to be exposed to light and such a photographic material is also provided with a bleachable yellow filter layer between the blue-sensitive silver halide emulsion layer and the green-sensitive emulsion layer, so as to absorb blue rays of light transmitting the blue-sensitive silver halide emulsion layer. Further, it is usually provided with other interlayers for the various particular purposes to each of the emulsion layers and also a protective layer to serve as the outermost layer. Further, a light-sensitive silver halide photographic material for color print use is generally coated with a red-sensitive, green-sensitive and blue-sensitive silver halide emulsion layers in order from the side to be exposed to light and, similar to the case of the above-mentioned light-sensitive silver halide photographic material for color negative use, interlayers including a UV absorving layer, a protective layer and so forth are provided with the verious purposes, respectively.

It is also well known to provide each of such silver halide emulsion layers in the different arrangements than the above, as well as to use light-sensitive silver halide emulsion layers each comprising two layers sensitive to the same wave-length region of the respective color lights.

In the above-mentioned light-sensitive silver halide color photographic materials, a dye image is formed in such a manner that exposed silver halide grains are developed by making use of a color developing agent such as an aromatic primary amine type color developing agent and the resulting oxidized products of the color developing agent is so reacted with dye forming couplers as to form the dye image.

In the above-mentioned method, a cyan, magenta and yellow couplers are ordinarily used for the cyan, magenta and yellow dye images, respectively.

In the field of the art, there are demands, in recent years, for color light-sensitive materials capable of being rapidly processed, redering an excellent image quality and a processing stability, and inexpensive in cost. In particular, there are more demands for color light-sensitive materials each capable of being rapidly processed.

To be more concrete, light-sensitive silver halide photographic materials are processed running with automatic processors installed at various photofinishing laboratories. These laboratories are requested to finish the materials and return them to their customers within the very same day when they received the processing orders thereof, for the service improvements to their customers. Recently, it is further requested to return finished materials to their customers within several hours after receipt of orders. The developments of further more rapidly processable color light-sensitive materials are urgently and increasingly demanded.

Generally, the above-mentioned dye images are formed in such a manner that a normally exposed color light-sensitive material is color-developed, bleached and fixed (or bleach-fixed in one step). and then washed. As for color print papers particularly required for a rapid processability, the most essential technique required is to shorten the color developing step.

There are several techniques for rapid processing methods, and one of the most effective techniques for shortening a color developing step is to increase a pH value of a color developer used. Namely, the increase in a pH value of a developer not only accelerates a silver development rate of a color developing agent used in an exposed silver halide emulsion, but also remarkably activates a reaction of the oxidized products of the color developing agent, which was resulted from the silver development, with couplers and, therefore, desirable photo- graphic characteristics such as a high sensitivity and a hard contrast can be displayed.

However, when a color development was made rapid by raising a pH value of a color developer particularly under such a condition as in processing a color print paper, some problems were found.

Namely, there raised such a new problem that a color light-sensitive material is affected by the coloration of a color developer and so forth resulted from the fatigue of the color developer caused by an aerial oxidation at a high pH value.

There have so far been many proposals with the purpose of solving the above-mentioned new problem. For example, a method in which such an aerial oxidation inhibitor as a combination of a hydroxylamine and a water soluble sulfite is added to serve as a preservative into a color developer. When using such a combination, an aerial oxidation inhibitor capable of displaying some degrees of effectiveness, but not statisfactory effectiveness when using them independently.

A more effective aerial oxidation inhibitor may be prepared by increasing the amounts each of the hydroxylamine and the water-soluble sulfite in a developer, however, a dye stain may be produced more as each of them is increasingly added, because blue-sensitive spectral sensitizers may not be dissolved out from a color light-sensitive material. In color print papers, the above-mentioned dye stains become a serious defect in quality. On the other hand, when reducing the amounts of the hydroxylamine and the water-soluble sulfite added, the aerial oxidation inhibiting property is weakened and the preservability of a color developer is deteriorated and, therefore, the color developer is so increasingly colored as to increase the fatigue of the color developer.

SUMMARY OF THE INVENTION

It is an object of the invention to provide a method of processing light-sensitive silver halide photographic material capable of preventing stains resulted by a spectral sensitizer used under a rapid processing condition.

Another object of the invention is to provide a light-sensitive silver halide photographic material not having any color comtamination.

Thus the present invention relates to a method of processing a light-sensitive silver halide photographic material comprising a step of processing an imagewise exposed light-sensitive silver halide photographic material comprising a support and, provided thereon, at least one silver halide emulsion layer containing silver halide grains which are sensitized with a sensitizing dye represented by general formula [I];

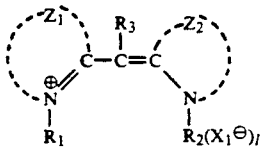

[I]

[wherein $Z_1$ and $Z_2$ independently represent a group of atoms necessary to complete a heterocyclic ring selected from a group consisting of a thiazole, a benzothiazole, a naphthothiazole, a selenazole, a benzoselenazole, a naphthoselenazole, a benzoimidazole, a naphthoimidazole, a pyridine and a quinoline, provided that the $Z_1$ and $Z_2$ do not simultaneously represent a naphthothiazole, a naphthoselenazole or a quinoline ring; $R_1$ and $R_2$ independently selected from a group consisting of an alkyl group, an alkenyl and an aryl group; $R_3$ is selected from a group consisting of hydrogen atom, a methyl group and an ethyl group; $X_1\ominus$is an anion; and l is an 0 or 1.]; with a color developer solution containing an aromatic primary amine color developing agent and at least one compound represented by general formula [II];

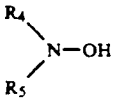

[II]

[wherein $R_4$ and $R_5$ independently represent an alkyl group.]

DETAILED DESCRIPTION OF THE INVENTION

In the above-given General Formula [I], the heterocyclic ring represented by $Z_1$, $Z_2$ include, preferably, a thiazole, a benzothiazole, a naphthothiazole, a selenazole, a benzoselenazole and a naphthoselenazole rings, more preferably, a thiazole, a benzothiazole, a selenazole and a benzoselenazole rings and, most preferably, a benzothiazole ring;

The above-mentioned nuclei may be substituted by various substituents including, for example, a halogen atom, a hydroxyl group, a cyano group, an aryl group, an alkyl group, an alkoxy group or an alkoxycarbonyl group, more preferably, a halogen atom, a cyano group, an aryl group and an alkyl or alkoxy group each having 1 to 6 carbon atoms and, preferably in particular, a halogen atom, a cyano group, a methyl group, an ethyl group, a methoxy group and an ethoxy group;

$R_1$ and $R_2$ represent each an alkyl group, an alkenyl group or an aryl group and, among them, the alkyl groups each having 1 to 6 carbon atoms and, preferably in particular, an ethyl group, a propyl group and a butyl group, and these alkyl groups may be substituted by various substituents including preferably a carboxyl group and a sulfo group, provided, in this case, that an alkali metal ion or an ammonium ion and a salt may be formed. At least one of $R_1$ and $R_2$ may preferably be an alkyl group substituted by a sulfo group. The alkenyl groups include, for example, an allyl group and so forth, and the aryl groups include, for example, a phenyl group and so forth;

$R_3$ represents a hydrogen atom, a methyl group and an ethyl group and, preferably, a hydrogen atom;

$X_1\ominus$represents an anion including, preferably, the ions of chlorine, bromine, iodine and p-toluenesulfonic acid;

l is an integer of 0 or 1, provided, however, that l is 0 if at least one of the $R_1$ and $R_2$ represents a group having an intramolecular anion in itself such as a sulfo group.

(I-1)

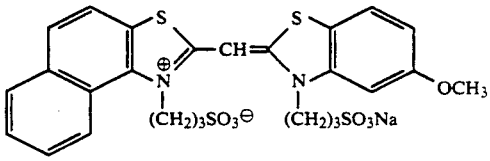

(I-2)

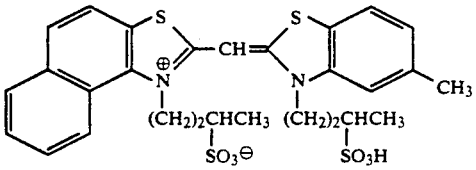

(I-3)

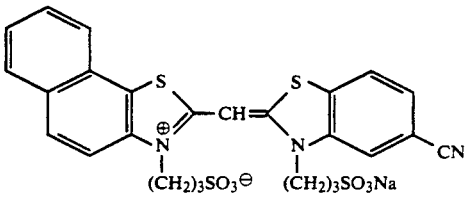

(I-4)

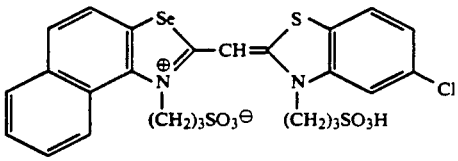

(I-5)

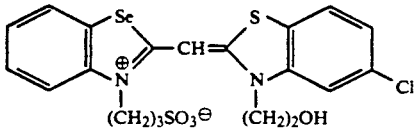

(I-6)

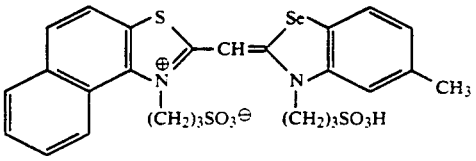

-continued
(I-7)
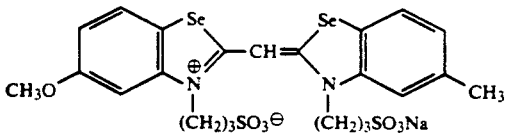
(I-8)
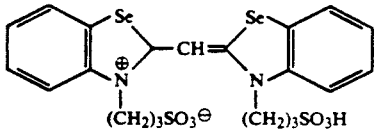
(I-9)
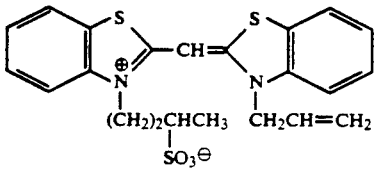
(I-10)
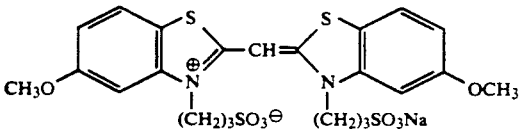
(I-11)
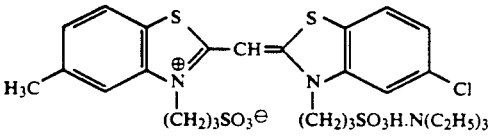
(I-12)
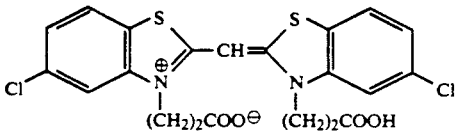
(I-13)
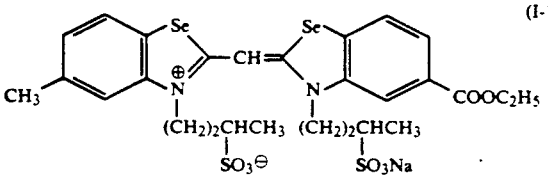
(I-14)
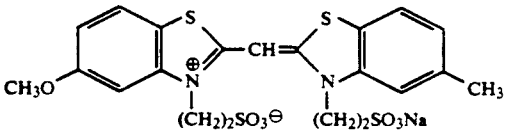
(I-15)
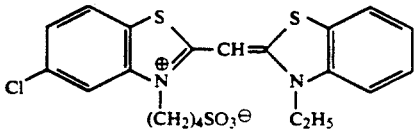
(I-16)
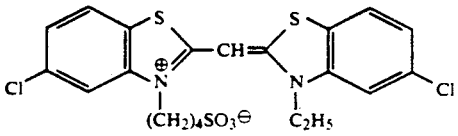
-continued
(I-17)
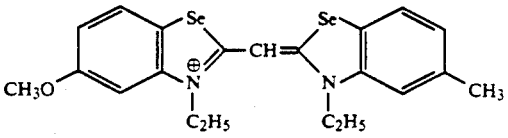
(I-18)
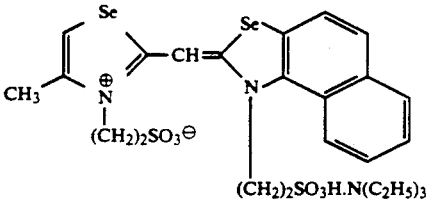
(I-19)
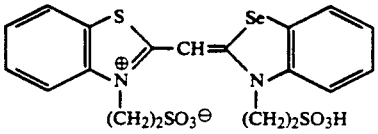
(I-20)
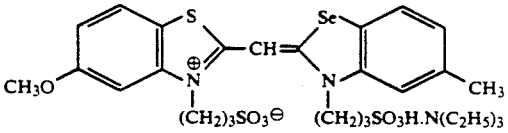
(I-21)
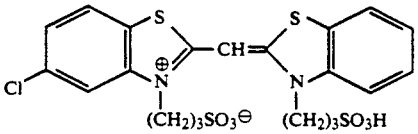
(I-22)
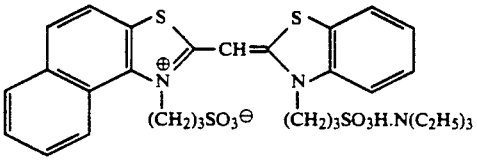
(I-23)
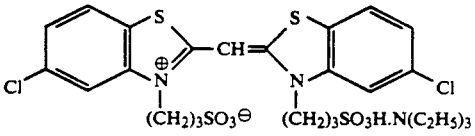
(I-24)
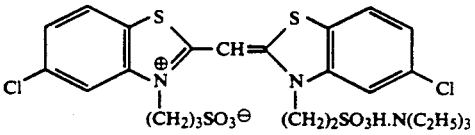
(I-25)
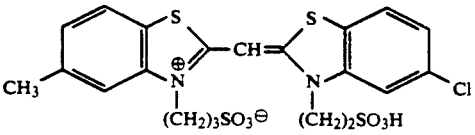
(I-26)
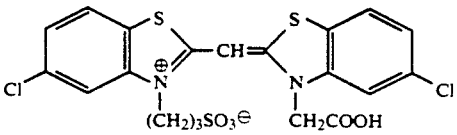

-continued (I-27)

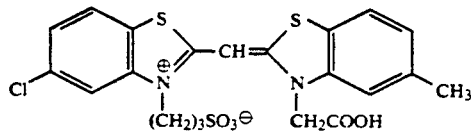

(I-28)

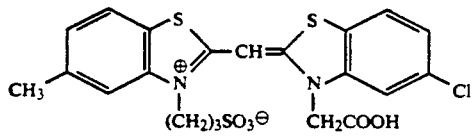

(I-29)

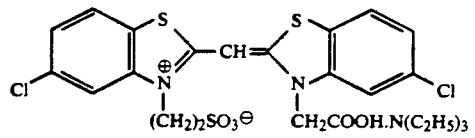

Among these exemplified compounds those which are most preferable in the present invention are (I-7), (I-9), (I-10), (I-11), (I-12), (I-14), (I-15), (I-16), (I-21), (I-22), (I-24), (I-25), I-26), I-27), (I-28) and (I-29)

The spectral sensitizers of the invention each represented by the aforegiven General Formula [1] may readily be synthesized in accordance with the methods described in, for example, British Patent No. 660,408 and U.S. Pat. No. 3,149,105.

It is advisable to add the spectral sensitizers of the invention each represented by the General Formula [I]into a silver halide emulsions after the spectral sensitizers are dissolved in such an organic solvent as a freely water-mixable methanol or ethanol. These spectral sensitizers may be added at any point of steps of preparing emulsions and it is, however, generally preferable to add these spectral sensitizers in the course of a chemical sensitization. Normally, they are preferably added in an amount of from 0.01 to 0.5 g per mol of silver halide used, depending upon the kinds of both spectral sensitizers and silver halide emulsions to be used.

The compounds each represented by the aforegiven General Formula [II] include, for example, N,N-dimethylhydroxylamine, N,N-diethylhydroxylamine, N,N-dipropylhydroxylamine and N,N-dibutylhydroxylamine. It is, however, to be understood that the invention shall not be limited thereto.

As for the water-soluble acids each of which may be used together with the compounds each represented by the aforegiven General Formula [II] for forming a salt, sulfuric acid hydrochloric acid, phosphoric acid, carbonic acid, acetic acid and oxalic acid may preferably be used for.

The compounds each represented by the aforegiven General Formula [II] may be added in an amount of, preferably, from 0.2 to 15 g per liter of a color developer used and, more preferably, from 0.5 to 10 g.

The effects of the invention may not be lowered even if any popularly known preservative such as sodium sulfite, potassium sulfite, potassium bisulfite, sodium bisulfite or hydroxylamine sulfate is jointly used.

The methods of the invention for processing a light-sensitive silver halide photographic material are characterized, as described above, in that the stain problems which are raised from using a blue-sensitive spectral sensitizer when the light-sensitive material is treated in a rapid color development process can be prevented by adopting both of a secondary hydroxylamine substituted with an alkyl group and a specific blue-sensitive spectral sensitizer.

Silver halide emulsions which are to be used in the invention may be comprised of any silver halide such as silver chloride, silver bromide, silver bromide, silver chlorobromide, silver iodobromide, silver chloroiodobromide and so forth and, preferably, silver chlorobromide and, in particular, silver chlorobromide containing silver chloride in an amount of not less than 30 mol %.

There is no special limitation to the average grain sizes of the above-mentioned monodispersetype silver halide grains, however, the average grain sizes thereof are, preferably, not larger than 0.9 μm and, more preferably, not larger than 0.8 μm.

The silver halide grains which are to be used in the invention may be either of such a regular configuration as cubic, octahedral, tetradecahedral and the like configurations or of such an irregular configuration as spherical and the like configurations.

The silver halide grains such as those having the above-mentioned configurations may be obtained in any grain-forming processes such as an acid process, a neutral process, an ammonia process and so forth which have so far been well-known.

When growing up such silver halide grains, it is preferred to control a pH value, a pAg value and the like in a reaction furnace. As is described in Japanese Patent O.P.I. Publication No. 48521/1979 for example, it is preferred to add silver ions and halide ions gradually at the same time in the respective amounts each corresponding to the growth rate of the silver halide grains being grown.

According to the above-mentioned process, monodisperse type silver halide grains having a regular crystal form and a nearly uniform grain size may be obtained. It is also allowed to use the mixture of not less than two kinds of monodisperse type silver halide emulsions each separately prepared.

The silver halide emusions of the light-sensitive silver halide emulsion layers each relating to the invention may also be doped with platinum, palladium, iridium, rhodium, ruthenium, bismouth, cadmium, copper or the like in the course of growing the silver halide grains thereof or after growing the same.

Unnecessary soluble salts may also be removed from the above-mentioned silver halide emulsions after the grains are grown up, or the salts may remain as they are contained. For the purpose of removing such salts, any of conventionally known salt-removing processes such as a noodle-washing process, a dialysis process, a coagulation-washing process and the like processes may be applied for.

Further, the above-mentioned silver halide emulsions may be chemically sensitized. Namely, they may be sensitized with sulfur sensitizers such as allylthiocarbamide, N,N-diphenylthiourea, cystine and so forth; noble metal sensitizers such as a gold compound, a palladium compound, a platinum compound, a ruthenium compound, a rhodium compound, an iridium compound and so forth; or a combination thereof. Still further, a reduction sensitization may be made with a reducing agent such as hydrogen gas, stannous chloride and so forth.

The light-sensitive silver halide photographic materials of the invention are also allowed to contain appropriately a variety of well-known photographic additives such as an antistatic agent, a hardener, a surfactant, a plasticizer, wetting agent, a filter dyestuff and so forth.

In the light-sensitive silver halide photographic materials of the invention, the hydrophilic colloids which are to be used for preparing emulsions include any one of gelatins, derivative gelatins, graft polymers each comprising a gelatin and other macromolecules, such a protein as albumin, casein and so forth, such a cellulose derivative as a hydroxyethyl cellulose derivative, a carboxymethyl cellulose and so forth, starch derivatives, synthesized hydrophilic macromolecular monomaers or copolymers such as polyvinyl alcohol, polyvinyl imidazole, polyacryl amide and so forth; and the like. The light-sensitive silver halide photographic materials of the invention ar prepared in such a manner that the emulsion layers of the invention containing a variety of the above-mentioned photographic additives along with other component layers are coated over to a support treated by corona-discharge, flame or UV-irradiation, with the interposition of a subbing layer and interlayers. The supports which may advantageously be used include, for example, a baryta paper, a polyethylene-coated paper, a polypropylene synthetic paper or a transparent support having a reflecting layer or member including, for example, a glass plate, such a polyester films as those made of cellulose acetate, cellulose nitrate, polyethyleneterephthalate and so forth, a polyamide film, a polycarbonate film, a polystyrene film and so forth. The such supports may suitably be selected to meet with the respective purposes of using such light-sensitive materials.

In the light-sensitive silver halide photographic materials of the invention, the emulsion layers and other component layers thereof are coated in a variety of coating processes including, for example, a dip-coating, air-doctor coating, curtain coating or hopper-coating process. It is also allowed to coat two or more layers simultaneously in such a process as described in, for example, U.S. Pat. Nos. 2,761,791 and 2,941,898.

In the invention, the position of each emulsion layer may freely be arranged. In the case of light-sensitive materials for full-color print use, for example, it is preferred to arrange a blue-sensitive emulsion layer, a green-sensitive emulsion layer and a red-sensitive emulsion layer in order from a support side.

In the invention, each component unit for forming dye images is comprised of a single layered or multilayered emulsion layer which is sensitive to a specific spectral region.

In a light-sensitive silver halide color photographic material, the layers necessary for them including the above-mentioned dye-forming unit layers may be arranged in various orders as well known in the art.

The typical light-sensitive silver halide multicolor photographic materials each are comprised of each support carrying thereon a cyan-dye image forming component unit comprising at least one red-sensitive silver halide emulsion layer containing at least one cyan coupler relating to the invention capable of forming a cyan-dye image, a magenta-dye image forming component unit comprising at least one green-sensitive silver halide emulsion layer containing at least one magenta coupler relating to the invention capable of forming a magenta-dye image, and a yellow-dye image forming component unit comprising at least one blue-sensitive silver halide emulsion layer containing at least one yellow coupler relating to the invention capable of forming a yellow-dye image.

The yellow-dye forming couplers preferably useful in the invention include the well-known acylacetanilide type couplers. Among such couplers, the benzoylacetanilide type compounds and the pivaloylacetanilide type compounds are advantageously used.

The examples of the useful yellow couplers include those described in British Patent No. 1,077,874; Japanese Patent Examined Publication No. 40757/1970; Japanese Patent O.P.I. Publication Nos. 1031/1972, 26133/1972, 94432/1973, 87650/1975, 3631/1976, 115219/1977, 99433/1979, 133329/1979 and 115219/1981; U.S. Pat. Nos. 2,875,057, 3,253,924, 3,265,506, 3,408,194, 3,551,194, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155 and 4,401,752; and so forth.

The magenta-dye forming couplers preferably useful in the invention include, for example, 5-pyrazolone type couplers. pyrazolobenzimidazole type couplers, pyrazolotriazole type couplers and open-chained acylacetanilide type couplers each of which have so far been well known.

The typical examples of the magenta couplers advantageously useful include those described in Japanese Patent Application Nos. 164882/1983, 167326/1983, 206321/1983, 214863/1983, 217339/1983 and 24653/1984; Japanese Patent Examined Publication Nos. 6031/1965, 6035/1965, 40757/1970, 27411/1972 and 37854/1974; Japanese Patent O.P.I. Publication Nos. 13041/1975, 26541/1976, 37646/1976, 105820/1976, 42121/1977, 123129/1978, 125835/1978, 129035/1978, 48540/1979, 29238/1981, 75648/1981, 17950/1982, 35858/1982, 146251/1982 and 99437/1984; British Patent No. 1,242,418; U.S. Pat. Nos. 2,600,788, 3.005,712, 3,062,653, 3,127,269, 3,214,437, 3,253,924, 3,311,476, 3,419,391, 3,519,429, 3,558,319, 3,582,322, 3,615,506, 3,658,544, 3,705,896, 3,725,067, 3,758,309, 3,823,156, 3,834,908, 3,891,445, 3,907,571, 3,926,631, 3,928,044, 3,935,015, 3,960,571, 4,076,533, 4,133,686, 4,237,217, 4,241,168, 4,264,723, 4,301,235 and 4,310,623; and so forth.

The cyan-dye forming couplers preferably useful in the invention include, for example, naphthol type couplers and phenol couplers which are well known.

The examples of the advantageously useful cyan couplers include those described in British Patent Nos. 1,038,331 and 1,543,040; Japanese Patent Examined Publication No. 36894/1973; Japanese Patent O.P.I. Publication No. 59838/1973, 137137/1975, 146828/1976, 105226/1978, 115230/1979, 29235/1981, 104333/1981, 126833/1981, 133650/1982, 155538/1982, 204545/1982, 118643/1983, 31953/1984, 31954/1984, 59656/1984, 124341/1984 and 166956/1984; U.S. Pat. Nos. 2,369,929, 2,423,730, 2,434,272, 2,474,293, 2,698,794, 2,772,162, 2,801,171, 2,895,826, 3,253,924, 3,311,476, 3,458,315, 3,476,563, 3,591,383, 3,737,316, 3,758,308, 3,767,411, 3,790,384, 3,880,661, 3,926,634, 4,004,929, 4,009,035, 4,012,258, 4,052,212, 4,124,396, 4,134,766, 4,138,258, 4,146,396, 4,149,886, 4,178,183, 4,205,990, 4,254,212, 4,264,722, 4,288,532, 4,296,199, 4,296,200, 4,299,914, 4,333,999, 4,334,011, 4,386,155, 4,401,752 and 4,427,767; and so forth.

It is allowed that one and the same blue-sensitive, green-sensitive or red-sensitive silver halide emulsion layer contains two or more kinds of the above-mentioned yellow, magenta and cyan couplers, respectively. It is also allowed that two or more separate layers having the same color sensitivity contain the same couplers, respectively.

The above-mentioned yellow, magenta and cyan couplers each are to be used generally in an amount within the range between $2\times10^{-3}$ mol and I mol per mol of silver used in an emulsion layer and more preferably between $1\times10^{-2}$ mol and $8\times10^{-1}$ mol.

The above-mentioned couplers are to be dispersively contained in the respective silver halide emulsion layers by making use of the high boiling organic solvents which will be described later.

The high boiling solvents which are to be used in the invention include, for example, those having a boiling point of not lower than 150° C., such as a phenol derivative incapable of reacting with the oxidized products of a developing agent, an alkylphthalic acid ester, a phosphoric acid ester, a citric acid ester, a benzoic acid ester, an alkylamide, a fatty acid ester, a trimesic acid ester, and so forth.

The high boiling organic solvents capable of being used in the invention include, for example, those described in U.S. Pat. Nos. 2,322,027, 2,533,514, 2,835,579, 3,287,134, 2,353,262, 2,852,383, 3,554,755, 3,676,137, 3,676,142, 3,700,454, 3,748,141, 3,779,765 and 3,837,863; British Patent Nos. 958,441 and 1,222,753; West German OLS Patent No. 2,538,889; Japanese Patent O. P.I. Publication Nos. 1031/1972, 90523/1974, 23823/1975, 26037/1976, 27921/1976, 27922/1976, 26035/1976, 26036/1976, 62632/1975, 1520/1978, 1521/1978, 15127/1978, 119921/1979, 119922/1979, 25057/1980, 36869/1980, 19049/1981 and 81836/1981; Japanese Patent Examined Publication No. 29060/1973; and so forth.

The surface active agents serving as a dispersion assistant being used in the invention preferably include, for example, anionic surface active agents such as an alkylbenzene sulfonate, an alkylnaphthalene sulfonate, an alkyl sulfonate, an alkyl sulfate, an alkylphosphate, a sulfosuccinate, a sulfoalkyl polyoxyethylene alkylphenyl ether and so forth; nonionic surface active agents such as a steroid type saponin, an alkylene oxide derivative, a glycidol derivative and so forth; amphoteric surface active agents such as an amino acid, an aminoalkylsulfonic acid, an alkylbetaine and so forth; and cationic surface active agents such as a quaternary ammonium salt and so forth. The typical examples of the above-mentioned surface active agents are described in, for example, A Surface Active Agent Handbook, published by Sangyo-Tosho Co., 1966 and A Research of Emulsifying Agents and Apparatus and the Technical Data Thereof published by Kagaku-Hanron Co., 1978.

As for the antifogging agents and the stabilizers each useful in the invention, they may be given azaindenes including, for example, such a pentazaindene as described in U.S. Pat. Nos. 2,713,541, 2,743,180 and 2,743,181, such a tetrazaindene as described in U.S. Pat. Nos. 2,716,062, 2,444,607, 2,444,605, 2,756,147, 2,835,581 and 2,852,375, and Research Disclosure No. 14851, such a triazaindene as described in U.S. Pat. No. 2,772,164, such a polymerized azaindene as described in Japanese Patent O.P.I. Publication No. 211142/1982; quaternary onium salts including, for example, such a thiazolium salt as described in U.S. Pat. Nos. 2,131,038, 3,342,596 and 3,954,478, such a pyrylium salt as described in U.S. Pat. No. 3,148,067, such a phosphonium salt as described in Japanese Patent Examined Publication No. 40665/1975, and so forth: polyhydroxybenzenes including, for example, such a catechol as described in U.S. Pat. No. 3,236,652 and Japanese Patent Examined Publication No. 10256/1968, such a resorcin as described in Japanese Patent Examined Publication No. 44413/1981, such a gallate as described in Japanese Patent Examined Publication No. 4133/1968, and so forth; heterocyclic compounds including, for example, azoles such as the tetrazoles described in West German Patent No. 1,189,380, the triazoles described in U.S. Pat. No. 3,157,509, the benztriazoles described in U.S. Pat. No. 2,704,721, the urazols described in U.S. Pat. No. 3,287,135, the pyrazoles described in U.S. Pat. No. 3,106,467, the indazoles described in U.S. Pat. No. 2,271,229, the polymerized benztriazoles described in Japanese Patent O.P.I. Publication No. 90844/1984, and so forth, pyrimidines such as those described in U.S. Pat. No. 3,161,515, 3-pyrazolidones such as those described in U.S. Pat. No. 2,751,297, polymerized pyrolidones, i.e., polyvinylpyrolidones, such as those described in U.S. Pat. No. 3,021,213, and so forth; a variety of inhibitor precursers including, for example, those described in Japanese Patent O.P.I. Publication Nos. 130929/1979, 137945/1984 and 140445/1984, British Patent No. 1,356,142, U.S. Pat. Nos. 3,575,699, 3,649,267 and so forth; a sulfinic acid and a sulfonic acid derivative such as described in U.S. Pat. No. 3,047,393; such an inorganic acid salt as described in U.S. Pat. Nos. 2,566,263, 2,839,405, 2,488,709 and 2,728,663; and so forth.

The image stabilizers capable of being used in the invention include, preferably, a hydroquinone derivative, a gallic acid derivative, a phenol derivative and the bis substances thereof, a hydroxycoumaran and the spiro-substances thereof, a hydroxychroman and the spiro-substances thereof, a piperidine derivative, an aromatic amine compound, a benzdioxane derivative, a benzdioxol derivative, a silicon atom-containing compound, a thioether compound and so forth. The typical examples thereof include those described in, for example, British Patent No. 1,410,846; Japanese Patent O.P.I. Publication Nos. 134326/1974, 35633/1977, 147434/1977, 50630/1977, 145530/1979, 6321/1980, 21004/1980, 124141/1980, 3432/1984, 5246/1984 and 10539/1984; Japanese Patent Examined Publication Nos. 31625/1973, 20973/1974, 20974/1974, 23813/1975 and 27534/1977; U.S. Pat. Nos. 2,360,290, 2,418,613, 2,675,314, 2,701,197, 2,704,713, 2,710,801, 2,728,659, 2,732,300, 2,735,765, 2,816,028, 3,069,262, 3,336,135, 3,432,300, 3,456,079, 3,573,050, 3,574,627, 3,698,909, 3,700,455, 3,764,337, 3,935,016, 3,982,944, 4,013,701, 4,113,495, 4,120,723, 4,155,765, 4,159,910, 4,254,216, 4,268,593, 4,279,990, 4,332,886, 4,360,589, 4,430,425 and 4,452,884; and so forth.

The UV absorbing agents capable of being used in the invention include, for example, a benzophenone compound (such as those described in, for example, Japanese Patent O.P.I. Publication No. 2784/1971 and U.S. Pat. Nos. 3,215,530 and 3,698,907), a butadiene compound (such as those described in, for example, U.S. Pat. No. 4,045,229), a 4-thiazolidone compound (such as those described in, for example, U.S. Pat. Nos. 3,314,794 and 3,352,681), a benzotriazole compound substituted with an aryl group (such as those described in, for example, Japanese Patent Examined Publication Nos. 10466/1961, 1687/1966, 26187/1967, 29620/1969 and 41572/1973, Japanese Patent O.P.I. Publication Nos. 95233/1979 and 142975/1982, U.S. Pat. Nos. 3,253,921, 3,533,794, 3,754,919, 3,794,493, 4,009,038, 4,220,711 and 4,323,633, and Research Disclosure No. 22519), a benzoxydole compound (such as those described in, for example, U.S. Pat. No. 3,700,455), and a cinnamic acid ester compound (such as those described in, for example, U.S. Pat. Nos. 3,705,805 and 3,707,375 and Japanese Patent O.P.I. Publication No. 49029/1977). Further, the UV absorbing agents described in U.S. Pat. No. 3,499,762 and Japanese Patent O.P.I. Publication No. 48535/1979 may also be used. Besides the above, a UV absorbable coupler (such as an α-naphthol type cyan-dye forming coupler), a UV absorbable polymer (such as those described in, for example, Japanese Patent O.P.I. Publication Nos. 111942/1983, 178351/1983, 181041/1983, 19945/1984 and 23344/1984) and so forth may also be used. The above-mentioned UV absorbing agents may be mordanted in a specific layer.

The filter dyes or the dyes for preventing irradiation or for other various purposes each contain an oxanol dye, a hemioxanol dye, a merocyanine dye, a cyanine dye, a styryl dye or an azo dye. The useful dyes among them include, for example, an oxanol dye, a hemioxanol dye and a merocyanine dye. The typical examples thereof include those described in, for example, West German Patent No. 616,007; British Patent Nos. 584,609 and 1,177,429; Japanese Patent Examined Publication Nos. 7777/1951, 22069/1964 and 38129/1979; Japanese patent O.P.I. Publication Nos. 85130/1973, 99620/1974, 114420/1974, 129537/1974, 28827/1975, 108115/1977 and 185038: U.S. Pat. Nos. 1,878,961, 1,884,035, 1,912,797, 2,098,891, 2,150,695, 2,274,782, 2,298,731, 2,409,612, 2,461,484, 2,527,583, 2,533,472, 2,865,752, 2,956,879, 3,094,418, 3,125,448, 3,148,187, 3,177,078, 3,247,127, 3,260,601, 3,282,699, 3,409,433, 3,540,887, 3,575,704, 3,653,905, 3,718,472, 3,865,817, 4,070,352 and 4,071,312; PB Report No. 74175; phot. Abs. 1 28('21); and so forth.

The light-sensitive silver halide photographic materials of the invention are to be color-developed after they are exposed to light. In this case, the higher a pH value is, the faster a developing speed is and, therefore, a time required for completing a color development may be shortened, however, the stability of each processing liquid is contrarily worsened. Such a pH value is, preferably, not higher than pH 12 and, more preferably, from 10.0 to 11.5.

Also, the higher a processing temperature is, the more a processing time is shortened in a color developing step. If a processing temperature is too high, there will arise such a problem that fogs will be increased and the stability of processing liquids will be deteriorated and so forth. Therefore, a processing temperature is, preferably, not higher than 40° C.

Further, a processing time is, preferably, not longer than 100 seconds and, more preferably, from 90 to 45 seconds.

The color developing agents capable of being used in the invention typically include those of the p-phenylenediamine type, such as a diethyl-p-phenylenediamine chloride, a monomethyl-p-phenylenediamine chloride, a dimethyl-p-phenylenediamine chloride, a 2-amino-5-diethylaminotoluene chloride, a 2-amino-5-(N-ethyl-N-dodecylamino)toluene, a 2-amino-5-(N-ethyl-N-β-methanesulfonamidethyl-)aminotoluene sulfate, a 4-(N-ethyl-N-β-methanesulfonamidethylamino)aniline sulfate, a 4-(N-ethyl-N-β-hydroxyethylamino)aniline, a 2-amino-5-(N-ethyl-β-methoxyethylamino)toluene and so forth. The above-mentioned color developing agents may be used independently or in combination, or they may be used in combination with such a black-and-white developing agent as hydroquinone and so forth, if occasion demands. Generally, the above-mentioned color developing agents are also allowed to contain alkalis such as sodium hydroxide, potassium hydroxide, sodium carbonate, potassium carbonate and so forth.

The color developers of the invention are further allowed to contain various additives including, for example, benzyl alcohol, such a halogenated alkali metal as potassium bromide, potassium chloride and so forth, such a development regulator as citrazinic acid and so forth, various defoaming agents and surface active agents, such a organic solvent as methanol, dimethylformamide and so forth, provided that the above-mentioned benzyl alcohol is not always necessary for the color developers of the invention.

The light-sensitive silver halide photographic materials of the invention are to be bleached and fixed, or bleach-fixed, and washed, after they are color-developed. Many compounds may be used as the bleaching agents. They include, especially, a polyvalent metal compound of iron (III), cobalt (III), tin (II) (II) and so forth, such as the complex salts of the cations of the above-mentioned polyvalent metals and an organic acid, which typically include an aminopolycarboxylic acid such as ethylenediaminetetraacetic acid, nitrilotriacetic acid and N-hydroxyethyl ethylenediaminediacetic acid, and metal complex salts of malonic acid, tartaric acid, malic acid, diglycollic acid, dithioglycollic acid and so forth, or ferricyanic acid salts and dichromic acid salts, and so forth. They are used independently or in combination.

After a color light-sensitive material is color-developed and bleach-fixed, any unnecessary chemicals are to be removed therefrom in a washing step. It is, however, allowed to apply a washless stabilization step in place of the washing step, as disclosed in, for example, Japanese Patent O.P.I. Publication Nos. 14834/1983, 105145/1983, 134634/1983 and 18631/1983, Japanese Patent O.P.I. Publication Nos. 2709/1983 and 89288/1984, and so forth.

In the case of processing color light-sensitive materials with continuously replenishing each of a color-developer, bleach-fixer and stabilizer of the invention, the replenishing rates of the respective replenishers are 100 to 1000 ml per sq.meter of a color light-sensitive material and, more preferably, from 150 to 500 ml.

Even in a rapid processing, the invention can display almost the same dye-stain prevention effect as in any normal processing. It is also found that there is amazingly few dye-stains when observing with eye, the above-mentioned facts prove not only that any unexposed areas cannot be tinted but also that any color contaminations can be prevented from appearing on a magenta or cyan dye images (or on both images).

EXAMPLES

The examples of the invention will now be described in detail. It is, however, to be understood that the embodiments of the invention shall not be limited thereto.

EXAMPLE 1

The samples of light-sensitive silver halide color photographic materials were prepared in such a manner that the following component layers were coated over to a polyethylene laminated support, in order from the support side.

1st layer . . . A blue-sensitive silver chlorobromide emulsion layer

This layer contains gelatin in an amount of 1.2 g/m$^2$, blue-sensitive silver chlorobromide in an amount of 0.23 g/m$^2$ (in terms of a silver content) and a yellow coupler denoted by Y-1 (in an amount of 0.45 mol per mol of a silver halide used) dissolved in 0.50 g/m$^2$ of dioctyl phthalate.

2nd layer . . . An interlayer

This layer contains gelatin in an amount of 0.7 g/m$^2$, the irradiation dye denoted by the following AI-1 in an amount of 10 mg/m$^2$ and the dye denoted by the following AI-2 in an amount of 5 mg/m$^2$.

3rd layer . . . A green-sensitive silver chlorobromide emulsion layer

This layer contains gelatin in an amount of 1.25 g/m$^2$, green-sensitive silver chlorobromide in an amount of g/m$^2$ (in terms of silver content) and the magenta coupler denoted by the following M-1 (in an amount of 0.23 mol per mol of a silver halide used) dissolved in the solution mixed with dibutyl phthalate in an amount of 0.5 g/m$^2$ and ethyl acetate.

4th layer . . . An interlayer

This layer contains gelatin in an amount of 1.2 g/m$^2$.

5th layer . . . A red-sensitive silver chlorobromide emulsion layer

This layer contains gelatin in an amount of 1.4 g/m$^2$, red-sensitive silver chlorobromide in an amount of 0.20 g/m$^2$ (in terms of a silver halide used) and the cyan coupler denoted by the following C-1 in an amount of 0.45 f/m$^2$ dissolved in dioctyl phthalate in an amount of 0.20 g/m$^2$.

6th layer . . . A light absorption layer

This layer contains gelating in an amount of 1.0 g/m$^2$ and a UV absorbing agent, Tinuvin 32 g (manufactured by Ciba Geigy AG.) in an amount of 0.30 g/m$^2$ dissolved in dioctyl phthalate in an amount of 0.20 g/m$^2$.

7th layer . . . A protective layer

This layer contains gelatin in an amount of 0.5 g/m$^2$.

[Y-1]

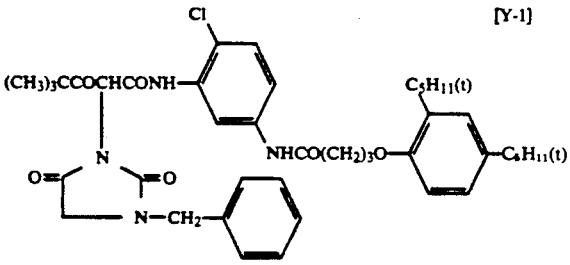

-continued

[M-1]

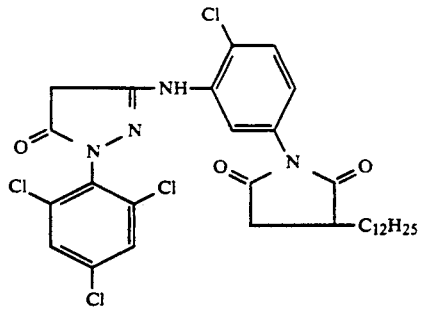

[C-1]

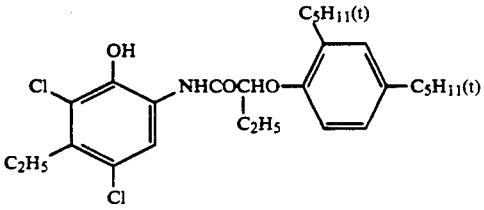

[AI-1]

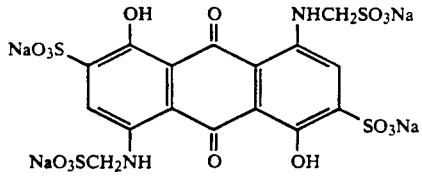

[AI-2]

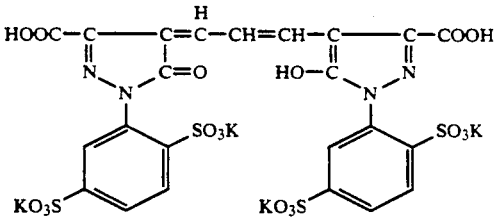

As is shown in Table 2, the spectral sensitizers in an amount of 0.4 g per mol of a silver halide used are added into the 1st layers when completing chemical ripening processes, respectively.

The samples prepared as mentioned above were developed as they were unexposed to light, by making use of the color developers shown in Table 1. with respect to the processed samples, the λmax density of their remaining spectral sensitizers were measured in a spectral reflection density measuring method by making use of a color analyser, Model 607, manufactured by Hitachi, Ltd.

| Processing Step | Temperature | Time |
|---|---|---|
| Color developing | 38° C. (Provided, CD-1 for 3 min) | 1 min |
| Bleach-fixing | 38° C. | 1 min |
| Washing | 30 to 40° C. | 1 min |
| Drying | 80 to 90° C. | 40 sec |

TABLE 1

| | CD-1 | CD-2 | CD-3 | CD-4 | CD-5 | CD-6 | CD-7 |
|---|---|---|---|---|---|---|---|
| N-ethyl-N-β-methanesulfonamidoethyl-3-methyl-4-aminoanilinosulfate | 10 g | 10 g | 10 g | 10g | 10 g | 10 g | 10 g |
| Ethylene glycol | 15 ml | 15 ml | 15 ml | 15ml | 15 ml | 15 ml | 15 ml |
| Banzyl alcohol | 18 ml | 18 ml | 18 ml | 18ml | 18 ml | 18 ml | 18 ml |
| Hydroxylamino | 2.0 g | — | 2.0 g | 0.8g | — | — | — |

TABLE 1-continued

| | CD-1 | CD-2 | CD-3 | CD-4 | CD-5 | CD-6 | CD-7 |
|---|---|---|---|---|---|---|---|
| sulfate | | | | | | | |
| Compounds of General Formula [II] | — | N,N-diethyl-hydroxyl-amine, 2.0 g | — | — | — | N,N-dimethyl-hydroxyl-amine, 0.6 g | N,N-dimethyl-hydroxyl-amine, 2.0 g |
| Anhydrous potassium carbonate | 25 g | 25 g | 25 g | 25g | 25 g | 25 g | 25 g |
| Potassium bromide | 0.5 g | 0.5 g | 0.5 g | 0.5g | 0.5 g | 0.5 g | 0.5 g |
| Sodium chloride | 1.5 g | 1.5 g | 1.5 g | 1.5g | 1.5 g | 1.5 g | 1.5 g |
| Anhydrous potassium sulfite | 2.0 g | 2.0 g | 2.0 g | 2.0g | 2.0 g | 2.0 g | 2.0 g |
| Pure water | 800 ml | 800 ml | 800 ml | 800ml | 800 ml | 800 ml | 800 ml |
| Pure water to be added to make 1 liter, and a pH value to which is to be adjusted with potassium hydroxide or sulfuric acid. | 10.2 | 10.02 | 11.5 | 11.5 | 11.5 | 11.5 | 11.5 |

| [Bleach-Fixer] | |
|---|---|
| Pure water | 600 ml |
| Iron (III) ammonium ethylenediaminetetraacetate | 65 g |
| 2-sodium ethylenediaminetetraacetate | 5 g |
| Ammonium thiosulfate | 85 g |
| Sodium hydrogensulfite | 10 g |
| Sodium metahydrogensulfite | 2 g |
| Disodium ethylenediaminetetraacetate | 20 g |
| Sodium bromide | 10 g |
| Color developer | 200 ml |
| Pure water to be added to make | 1 liter |
| pH to be adjusted with dilute sulfuric acid to | pH = 7 |

TABLE 2

| Sample No. | Color developer | Spectral sensitizer | Reflection density | |
|---|---|---|---|---|
| 1 | CD-1 | R-1 | 0.074 | Comparative |
| 2 | CD-1 | R-2 | 0.077 | Comparative |
| 3 | CD-1 | I-7 | 0.073 | Comparative |
| 4 | CD-1 | I-26 | 0.071 | Comparative |
| 5 | CD-2 | R-1 | 0.086 | Comparative |
| 6 | CD-2 | R-2 | 0.089 | Comparative |
| 7 | CD-2 | I-7 | 0.073 | Invention |
| 8 | CD-2 | I-26 | 0.070 | Invention |
| 9 | CD-3 | R-1 | 0.089 | Comparative |
| 10 | CD-3 | R-2 | 0.085 | Comparative |
| 11 | CD-3 | I-7 | 0.089 | Comparative |
| 12 | CD-3 | I-26 | 0.086 | Comparative |
| 13 | CD-4 | R-1 | 0.092 | Comparative |
| 14 | CD-4 | R-2 | 0.094 | Comparative |
| 15 | CD-4 | I-7 | 0.097 | Comparative |
| 16 | CD-4 | I-26 | 0.098 | Comparative |
| 17 | CD-5 | R-1 | 0.094 | Comparative |
| 18 | CD-5 | R-2 | 0.097 | Comparative |
| 19 | CD-5 | I-7 | 0.104 | Comparative |
| 20 | CD-5 | I-26 | 0.108 | Comparative |
| 21 | CD-6 | R-1 | 0.087 | Comparative |
| 22 | CD-6 | R-2 | 0.089 | Comparative |
| 23 | CD-6 | I-7 | 0.078 | Invention |
| 24 | CD-6 | I-26 | 0.071 | Invention |
| 25 | CD-7 | R-1 | 0.090 | Comparative |
| 26 | CD-7 | R-2 | 0.094 | Comparative |
| 27 | CD-7 | I-7 | 0.081 | Invention |
| 28 | CD-7 | I-26 | 0.070 | Invention |

In Table 2, Comparative Dyes R-1 and R-2 have the following chemical formulas:

R-1

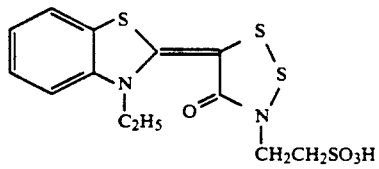

R-2

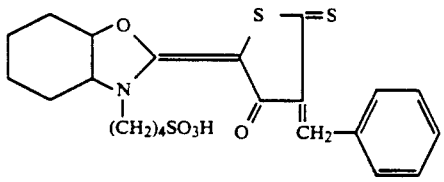

As is obvious from Table 2, It is understood that a reflection density in the background portion of the samples is satisfactorily restrained by the ordinary developing processes (cf. Samples Nos. 1 to 4). In contrast hereto, when the sample are processed by a rapid process (cf.Samples Nos. 5 through 28), it is found that the reflection densities of the samples according to the present invention (Samples Nos. 7, 8, 23, 24, 27 and 28) can be restrained more effectively than in the samples processed by the comparative processes (Samples Nos. 5, 6, 9 thru 22, 25 and 26).

EXAMPLE 2

The samples were prepared in the same manner as in the samples of the light-sensitive silver halide color photographic materials prepared in Example 1. The resulted samples were developed as they remained unexposed to light by making use of the color developers each shown in Table 3 and were then evaluated in the same way as in Example 1, respectively.

TABLE 3

| | CD-1 | CD-2 | CD-11 | Cd-12 | CD-13 | CD-14 | CD-15 |
|---|---|---|---|---|---|---|---|
| N-ethyl-N-β-methane-sulfonamidoethyl-3-methyl-4-amino-anilinosulfate | 10 g | 10 g | 10 g | 10 g | 10 g | 10 g | 10 g |
| Ethylene glycol | 15 ml | 15 ml | — | — | — | — | — |

TABLE 3-continued

| | CD-1 | CD-2 | CD-11 | Cd-12 | CD-13 | CD-14 | CD-15 |
|---|---|---|---|---|---|---|---|
| Banzyl alcohol | 18 ml | 18 ml | — | — | — | — | — |
| Hydroxylamino sulfate | 2.0 g | — | 2.0 g | 0.8 g | — | — | — |
| Compounds of General Formula [II] | — | — | — | — | — | N,N-dibutyl-hydroxyl-amine, 0.6 g | N,N-dibutyl-hydroxyl-amine, 2.0 g |
| Anhydrous potassium carbonate | 25 g | 25 g | 25 g | 25 g | 25 g | 25 g | 25 g |
| Potassium bromide | 0.5 g | 0.5 g | 0.5 g | 0.5 g | 0.5 g | 0.5 g | 0.5 g |
| Sodium chloride | 1.5 g | 1.5 g | 1.5 g | 1.5 g | 1.5 g | 1.5 g | 1.5 g |
| Anhydrous potassium sulfite | 2.0 g | 2.0 g | 2.0 g | 2.0 g | 2.0 g | 2.0 g | 2.0 g |
| Pure water | 800 ml | 800 ml | 800 ml | 800 ml | 800 ml | 800 ml | 800 ml |
| Pure water to be added to make 1 liter, and a pH value to which is to be adjusted with potassium hydroxide or sulfuric acid. | 10.2 | 10.02 | 11.5 | 11.5 | 11.5 | 11.5 | 11.5 |

TABLE 4

| Sample No. | Color developer | Spectral sensitizer | Reflection density | |
|---|---|---|---|---|
| 29 | CD-1 | R-1 | 0.073 | Comparative |
| 30 | CD-1 | I-5 | 0.074 | Comparative |
| 31 | CD-1 | I-22 | 0.073 | Comparative |
| 32 | CD-2 | R-1 | 0.085 | Comparative |
| 33 | CD-2 | I-5 | 0.073 | Invention |
| 34 | CD-2 | I-22 | 0.073 | Invention |
| 35 | CD-11 | R-1 | 0.087 | Comparative |
| 36 | CD-11 | I-5 | 0.094 | Comparative |
| 37 | CD-11 | I-22 | 0.092 | Comparative |
| 38 | CD-12 | R-1 | 0.092 | Comparative |
| 39 | CD-12 | I-5 | 0.100 | Comparative |
| 40 | CD-12 | I-22 | 0.099 | Comparative |
| 41 | CD-13 | R-1 | 0.093 | Comparative |
| 42 | CD-13 | I-5 | 0.105 | Comparative |
| 43 | CD-13 | I-22 | 0.104 | Comparative |
| 44 | CD-14 | R-1 | 0.090 | Comparative |
| 45 | CD-14 | I-5 | 0.083 | Invention |
| 46 | CD-14 | I-22 | 0.076 | Invention |
| 47 | CD-15 | R-1 | 0.091 | Comparative |
| 48 | CD-15 | I-5 | 0.081 | Invention |
| 49 | CD-15 | I-22 | 0.075 | Invention |

As is clearly understood from Table 4, the present invention (cf. Samples Nos. 33, 34, 45, 46, 48 and 49) can exert improved dye-stain prevention effect as compared with the comparative processes (cf. Samples Nos. 32, 35 thru 44 and 47).

What is claimed is:

1. An improved method for reducing color stain and contamination in light-sensitive silver halide color photographic materials developed using rapid processing means, said photographic materials comprising a support having provided thereon at least one blue-sensitive silver halide emulsion layer containing a dye forming coupler and silver halide grains, said improvement comprising;

sensitizing said blue-sensitive silver halide emulsion layer with a sensitizing dye represented by Formula (I)

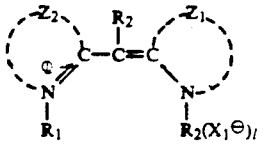

Formula (I)

wherein $Z_1$ and $Z_2$ represent independently a group of atoms necessary to form a heterocyclic ring selected from the group consisting of thiazole, benzothiazole, naphthothiazole, selenazole, benzoselenazole, and naphthoselenazole with a proviso that when $Z_1$ is naphthothiazole, $Z_2$ is not naphthothiazole, and when $Z_1$ is naphthoselenazole, $Z_2$ is not naphthoselenazole; $R_1$ and $R_2$ represent independently alkyl, alkenyl, and aryl; $R_3$ represents hydrogen, methyl or ethyl; $X_1$ represents an anion; and l is 0 or 1; and processing the photographic material, after exposure, with a developing solution containing an aromatic primary amine color developing agent, and at least one compound represented by Formula (II), or water soluble acid salt thereof;

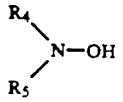

Formula (II)

wherein $R_4$ and $R_5$ represent independently an alkyl group having 1 to 4 carbon atoms.

2. The method of claim 1, wherein $R_1$ and $R_2$ independently represent an alkyl group having 1 to 6 carbon atoms.

3. The method of claim 2, wherein $R_1$ and $R_2$ independently represent an ethyl group, a propyl group, or a butyl group.

4. The method of claim 3 where at least one of $R_1$ and $R_2$ represent a carboxyalkyl group or a sulfoalkyl group.

5. The method of claim 1 wherein said sensitizing dye is 0.01 to 0.5 g per mole of silver halide.

6. The method of claim 1 wherein said compound represented by Formula (II) is present in an amount of 0.2 to 15 g/l of color developing solution.

7. The method of claim 6 wherein said amount is 0.5 to 10 g/l of color developing solution.

8. The method of claim 1 wherein at least one of $Z_1$ and $Z_2$ is thiazole, benzothiazole, selenazole, or benzoselenazole.

9. The method of claim 8 wherein at least one of $Z_1$ and $Z_2$ is benzothiazole.

* * * * *